US006321740B1

(12) United States Patent
Scherer et al.

(10) Patent No.: US 6,321,740 B1
(45) Date of Patent: Nov. 27, 2001

(54) BLOCK SPLITTER ASSEMBLY

(75) Inventors: Ronald James Scherer, Oak Park Heights; David M. LaCroix, Circle Pines, both of MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 09/330,879

(22) Filed: Jun. 11, 1999

(51) Int. Cl.[7] ..... B28D 1/26

(52) U.S. Cl. ..... 125/40; 125/23.01; 125/24; 125/30.01

(58) Field of Search ..... 125/23.01, 24, 125/30.01, 40

(56) References Cited

U.S. PATENT DOCUMENTS

| | | | | |
|---|---|---|---|---|
| 806,951 | | 12/1905 | Bryning . | |
| 2,775,236 | * | 12/1956 | Blum | 125/18 |
| 3,120,842 | * | 2/1964 | Cox et al. | 125/23 |
| 3,559,631 | * | 2/1971 | Mangis | 125/23 |
| 3,809,049 | * | 5/1974 | Fletcher et al. | 125/23 |
| 4,335,549 | | 6/1982 | Dean, Jr. . | |
| 4,848,309 | | 7/1989 | Alderete . | |
| 5,017,049 | | 5/1991 | Sievert . | |
| 5,066,070 | | 11/1991 | Clarke . | |
| 5,152,275 | * | 10/1992 | Landhuis | 125/12 |
| 5,413,086 | | 5/1995 | Trudeau . | |
| 5,662,094 | | 9/1997 | Giacomelli . | |
| 5,722,386 | * | 3/1998 | Fladgard et al. | 125/23.01 |
| 6,050,255 | | 4/2000 | Sievert . | |

* cited by examiner

*Primary Examiner*—Derris H. Banks
*Assistant Examiner*—Shantese McDonald
(74) *Attorney, Agent, or Firm*—Merchant & Gould PC

(57) ABSTRACT

The invention is a block splitting machine which uses an assortment of protrusions to supplement or replace the action of the splitting blade in splitting and dressing masonry block.

55 Claims, 9 Drawing Sheets

BLOCK SPLITTER ASSEMBLY

FIELD OF THE INVENTION

The invention relates generally to manufacture of masonry block. More specifically, it relates to equipment and processes for the creation of decorative faces on masonry block. Even more specifically, the invention relates to equipment and processes for producing roughened textures and the appearance of weathered edges on masonry block.

BACKGROUND OF THE INVENTION

The process of splitting a masonry block to create a rock-like appearance on the exposed face of the block is known. See, for example, Besser, U.S. Pat. No. 1,534,353, which discloses the manual splitting of blocks using a hammer and chisel. Automated equipment to split block is well-known, and generally includes a splitting table comprising a supporting table and one or more hydraulically-actuated splitting blades. These machines are useful for the high-speed processing of blocks. They produce a rock-face finish on the blocks. The edges of the faces are generally well-defined, i.e., "sharp".

It is sometimes desirable to produce a concrete product that has edges which appear to be weathered. This has been a desired look for concrete pavingstones for sometime. Recently, it has become desirable to create the weathered look on the decorative face of concrete retaining wall blocks. The common process for producing the weathered look on pavers is to "tumble" the pavers in a rotary drum to knock off their sharp edges. This process can be used with some retaining wall blocks, as well, provided that the blocks do not have any features, such as integral concrete locator flanges, that would be damaged by the tumbling process. Tumbling is not an option with such blocks. The problem with the tumbling process is that it is costly. The process requires the capital investment in a tumbling apparatus, and the upkeep of that equipment. In addition, the pavers or blocks must be removed from the production line, tumbled, and then reassembled into suitable cubes for transportation. This makes the process labor-intensive.

Another option is to use a hammermill to attack the face of the block with various hammers. This option can slow down production, if it is done "in line", because the process can only move as fast as the hammermill can operate on each block, and the block may need to be manipulated-flipped over and or rotated-to attack all of its edges.

Accordingly, there is a need for equipment and a process that will create the appearance of weathered edges on retaining wall block, in such a manner that it will not slow down the production line, will not add costly equipment to the line, will not be labor-intensive, and will not have high cull rates when processing blocks with integral locator flanges or other similar features.

SUMMARY OF THE INVENTION

In accordance with a first aspect of the invention, there is provided a block splitter assembly comprising first and second opposed splitting blade assemblies, each of the first and second splitting blade assemblies comprising respective first and second splitting blades and one or more projections positioned adjacent to each of the first and second blades.

In accordance with a second aspect of the invention, there is provided a block splitter comprising first and second opposed splitting blade assemblies, each of the first and second opposed splitting blade assemblies comprising a plurality of projections.

In accordance with another aspect of the invention, there is provided a masonry block splitter comprising first and second opposed splitting blade assemblies, the first blade assembly comprising a first splitting blade having first and second sides, said first blade assembly comprising a plurality of projections adjacent the first splitting blade first side and a plurality of projections adjacent the first splitting blade second side, the second blade assembly comprising a second splitting blade having first and second sides, the second blade assembly comprising a plurality of projections adjacent the second splitting blade first side and a plurality of projections adjacent the second splitting blade second side.

In accordance with a further aspect of the invention, there is provided a method of splitting masonry block using a masonry block splitter, comprising first and second opposed splitting blade assemblies, said first blade assembly comprising a first splitting blade having first and second sides, said first blade assembly comprising a plurality of projections adjacent said first splitting blade first side and a plurality of projections adjacent said first splitting blade second side, said second blade assembly comprising a second splitting blade having first and second sides, said second blade assembly comprising a plurality of projections adjacent said second splitting blade first side and a plurality of projections adjacent said second splitting blade second side, said method comprising the step of striking the masonry block with said first and second opposed splitting blade assemblies.

DETAILED DESCRIPTION OF THE PREFERRED EMBODIMENT

Figure 1:
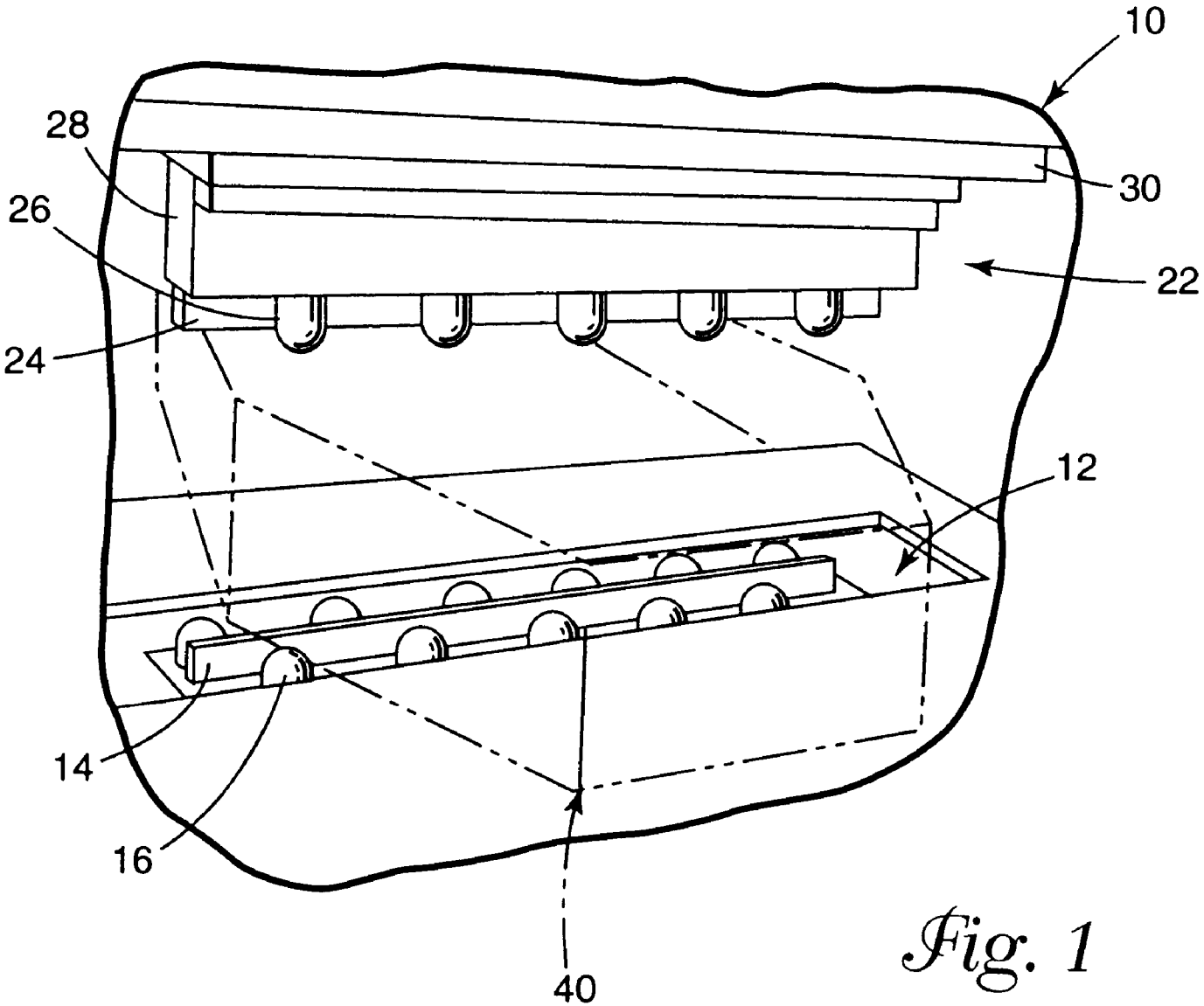
FIG. 1 is a partial perspective view of a block splitting machine using the block splitter blade assembly of the invention.

Attention is now directed to the figures where like parts are identified with like numerals through several views. In FIG. 1, a conventional block splitting machine modified in accordance with invention is depicted, in part, showing in particular the block splitter assembly 10. Generally, block splitting machines may be obtained from Lithibar Co., located in Holland, Mich. In particular, the Lithibar Co. 6386 was used in practicing the invention. The block splitter assembly generally has opposed first 12 and second 22 splitting blade assemblies. The first splitting blade assembly 12 is positioned at the bottom of the block splitter 10 and, as depicted, includes a splitting blade 14 and a number of protrusions positioned on either side and adjacent to the blade.

The invention may be used with any variety of blocks molded or formed through any variety of processes including those blocks and processes disclosed in U.S. Pat. No. 5,827,015 issued Oct. 27, 1998, U.S. Pat. No. 5,017,049 issued May 21, 1991 and U.S. Pat. No. 5,709,062 issued Jan. 20, 1998.

An upper or second splitting blade assembly 22 may also be seen in FIG. 1. The second splitting blade assembly 22 also includes a splitting blade 24 and a plurality of projections 26 located on either side of the blade 24. The second splitting blade assembly may be attached to the machine's top plate 30 through a blade holder 28. The position of the work piece 40, (shown in phantom), within the block splitter may be seen in FIG. 1, in the ready-to-split position.

Figure 2B:
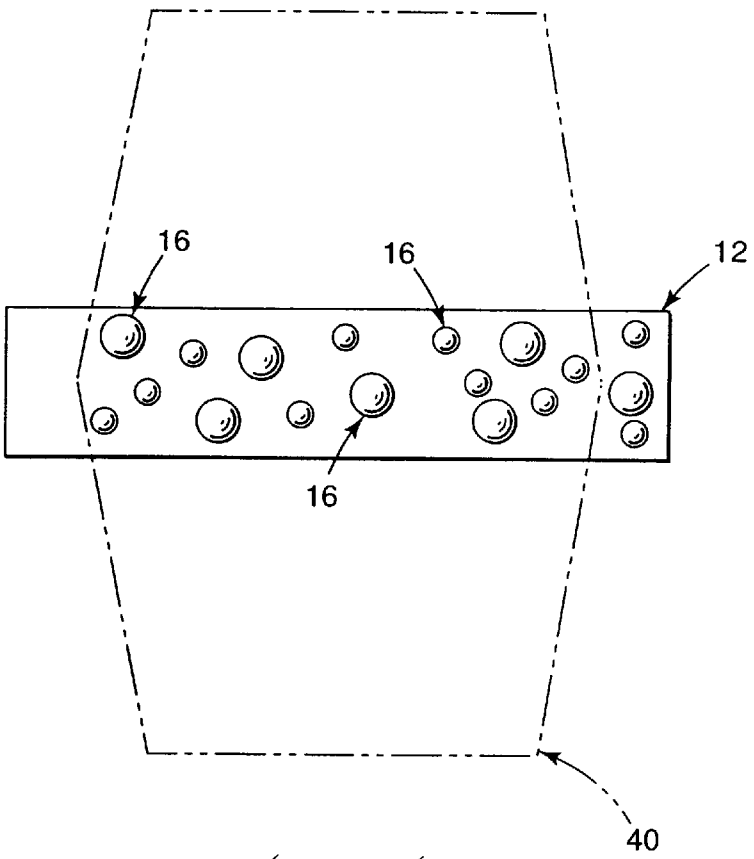
FIG. 2B is a top plan view of one portion of a splitting blade assembly also showing protusions of various diameters positioned in a random manner.
Figure 2A:
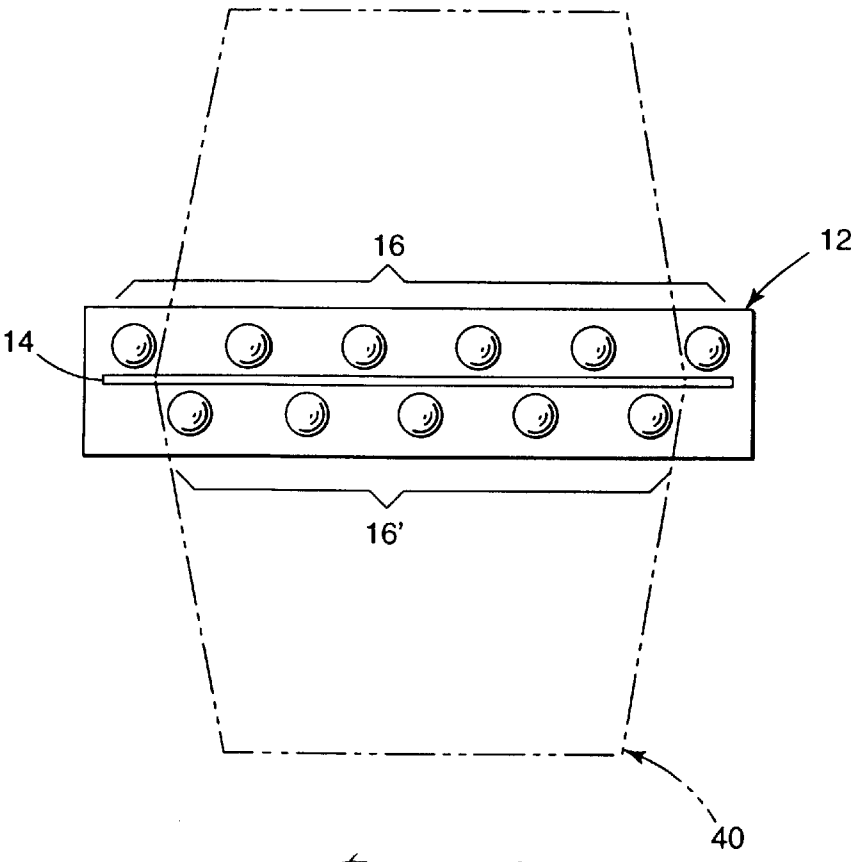
FIG. 2A is a top plan view of one portion of a splitting blade assembly in accordance with the invention.

As can be seen in FIG. 2A, the splitting blade assembly 12 is generally comprised of a number of projections 16 positioned adjacent to blade 14 and on either side of the blade 14. As shown, the projections 16 on the first side of the blade are staggered in relationship to the projections 16' on the second side of the blade. The projections on either side of the blade may also be aligned depending upon the intent of the operator.

As can be seen in FIG. 2B, the protrusions 16 may be used without a splitting blade. The protrusions 16 may also be varied in diameter or perimeter, (if not round), and placed randomly on the splitting assembly 12. Any number of ordered or random patterns of protrusions 16 may be created using regular or irregular spacing depending on the effect to be created in the split block.

Figure 2C:
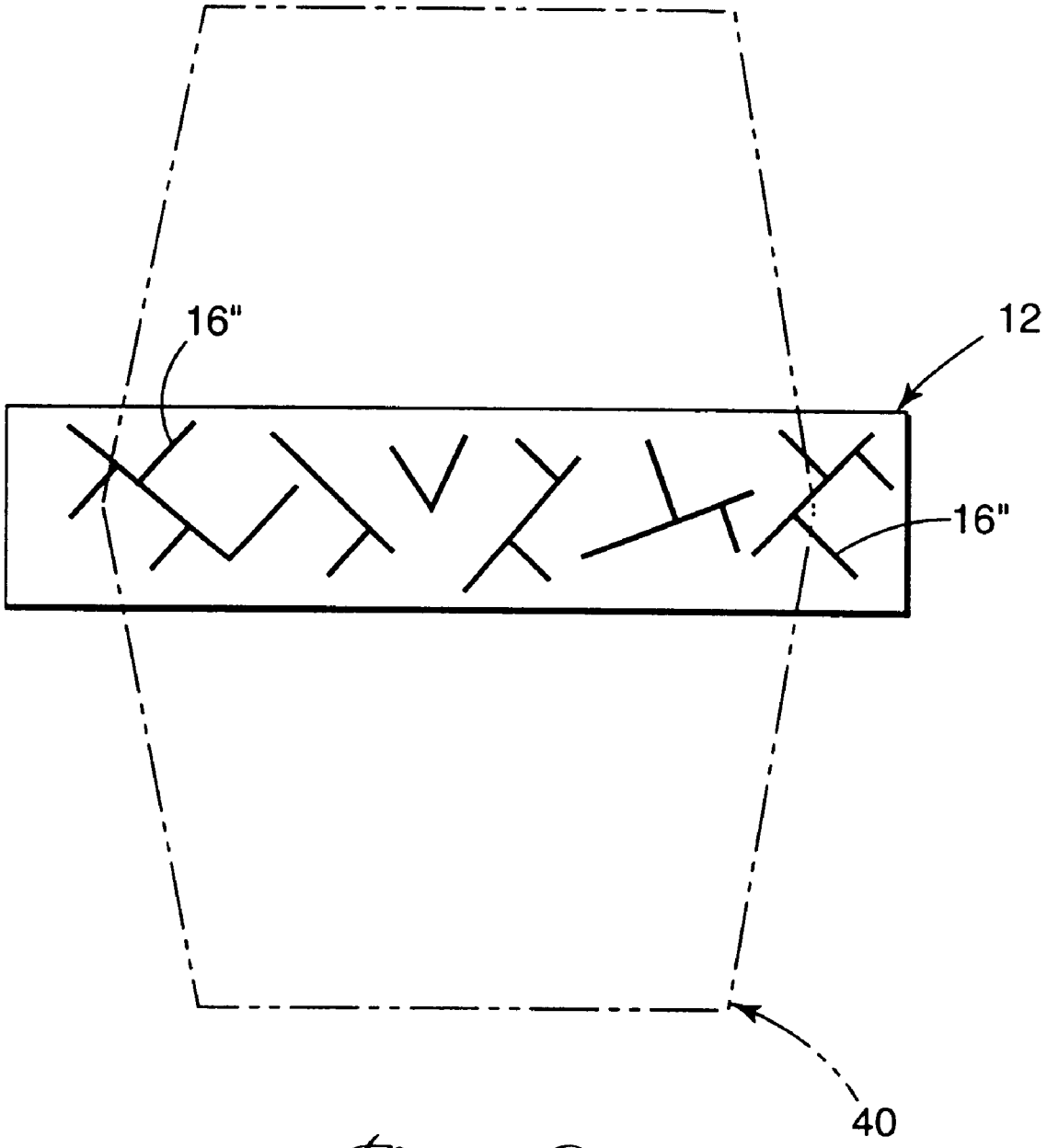
FIG. 2C is a top plan view of one portion of a splitting blade assembly in accordance with a further alternative embodiment of the invention comprising protrusions which are random connected and unconnected panels.

FIG. 2C shows a further alternative embodiment of the invention where plates 16" are attached to either, or both, assemblies 12 and 22. As can be seen, these plates may be configured in random order and left unconnected across the surface of the assembly 12. The invention has been practiced using steel plates about four inches long welded to the assembly to provide a number of partially connected protrusions 16" about two inches high.

As shown in FIGS. 1, 2A and 2B, the projection 16 and 16' may have a rounded shape. However, the shape of the projections may also be pyramidal, cubic, or pointed with one or more points on the top surface of the projection. In FIGS. 2B and 2C, the relative position of the work piece 40 is again shown in phantom outline.

Generally, the protrusions may have a diameter of about ½ to 1 and ¼ inches and may be attached by welding, screwing or other suitable means. The height of the protrusions may be about 1 and ¼ inches and varied about ¾ of an inch shorter or taller depending upon the affect to be created in the block at splitting. Attaching the protrusions by threading or screwing allows easy adjustment of protrusion height.

Figure 3:
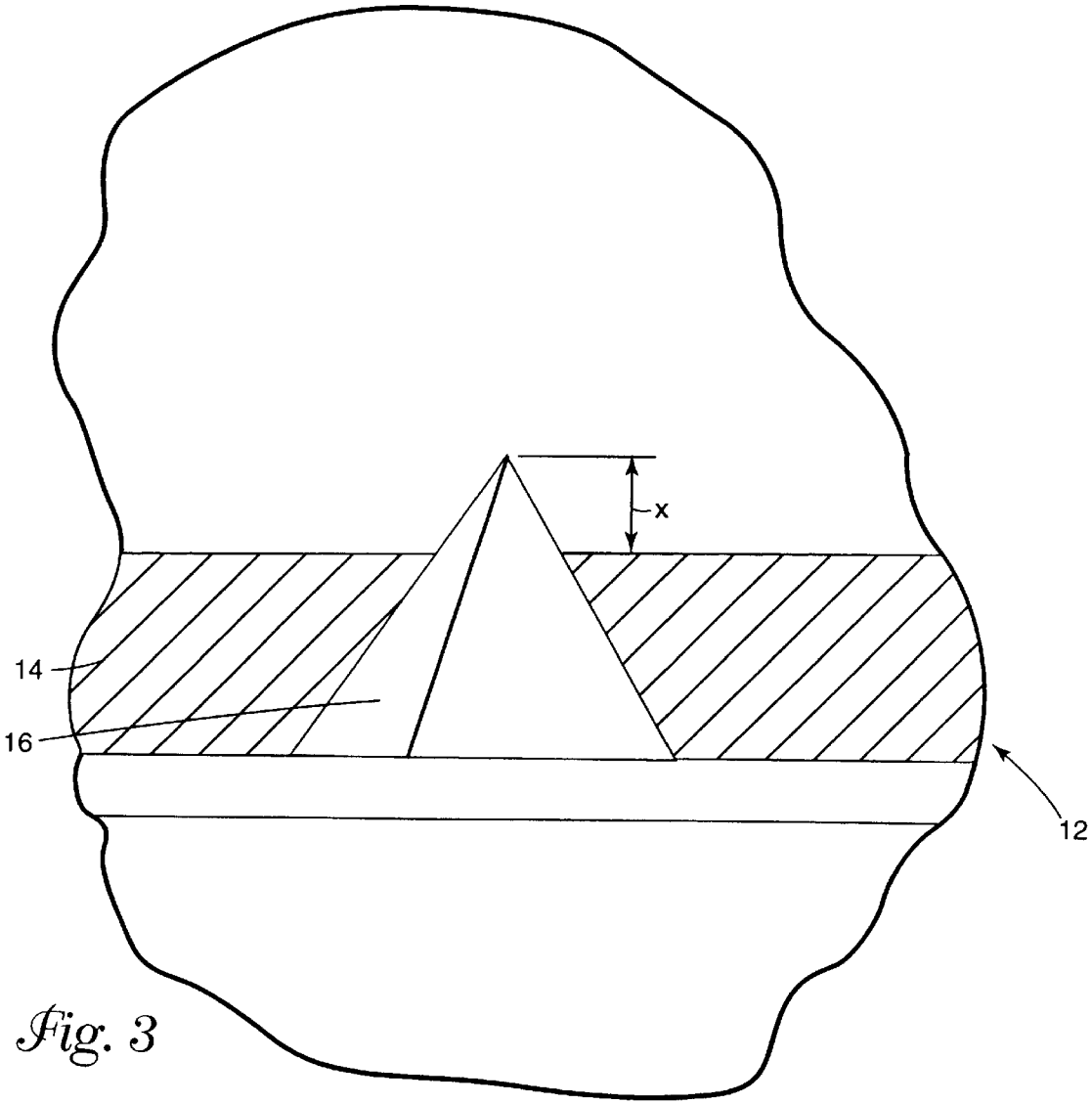
FIG. 3 is a side elevational view of an alternative embodiment of a protrusion in accordance with the invention.
Figure 4A:
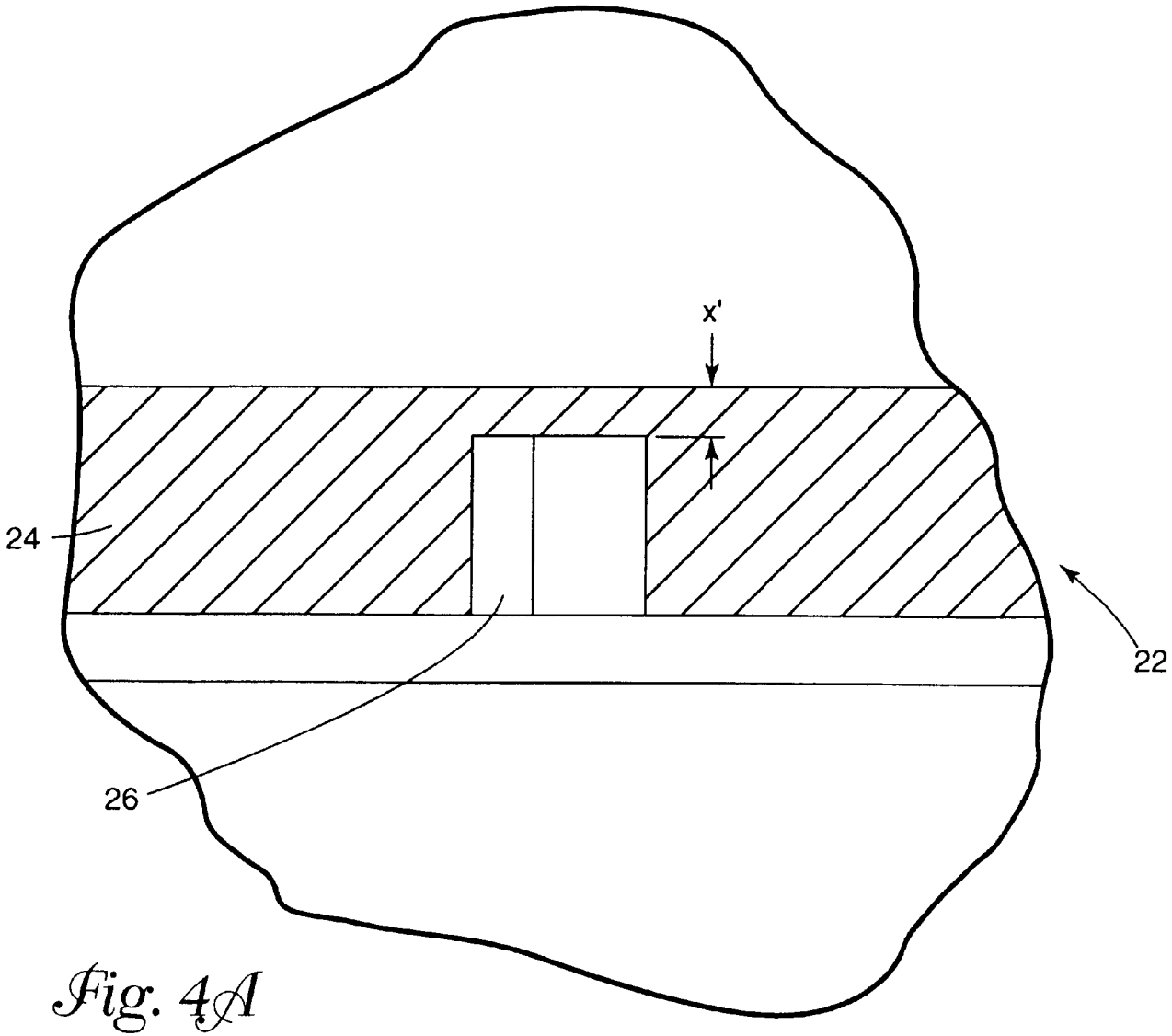
FIG. 4A is a side elevational view of a further alternative embodiment of a protrusion in accordance with the invention.
Figure 4B:
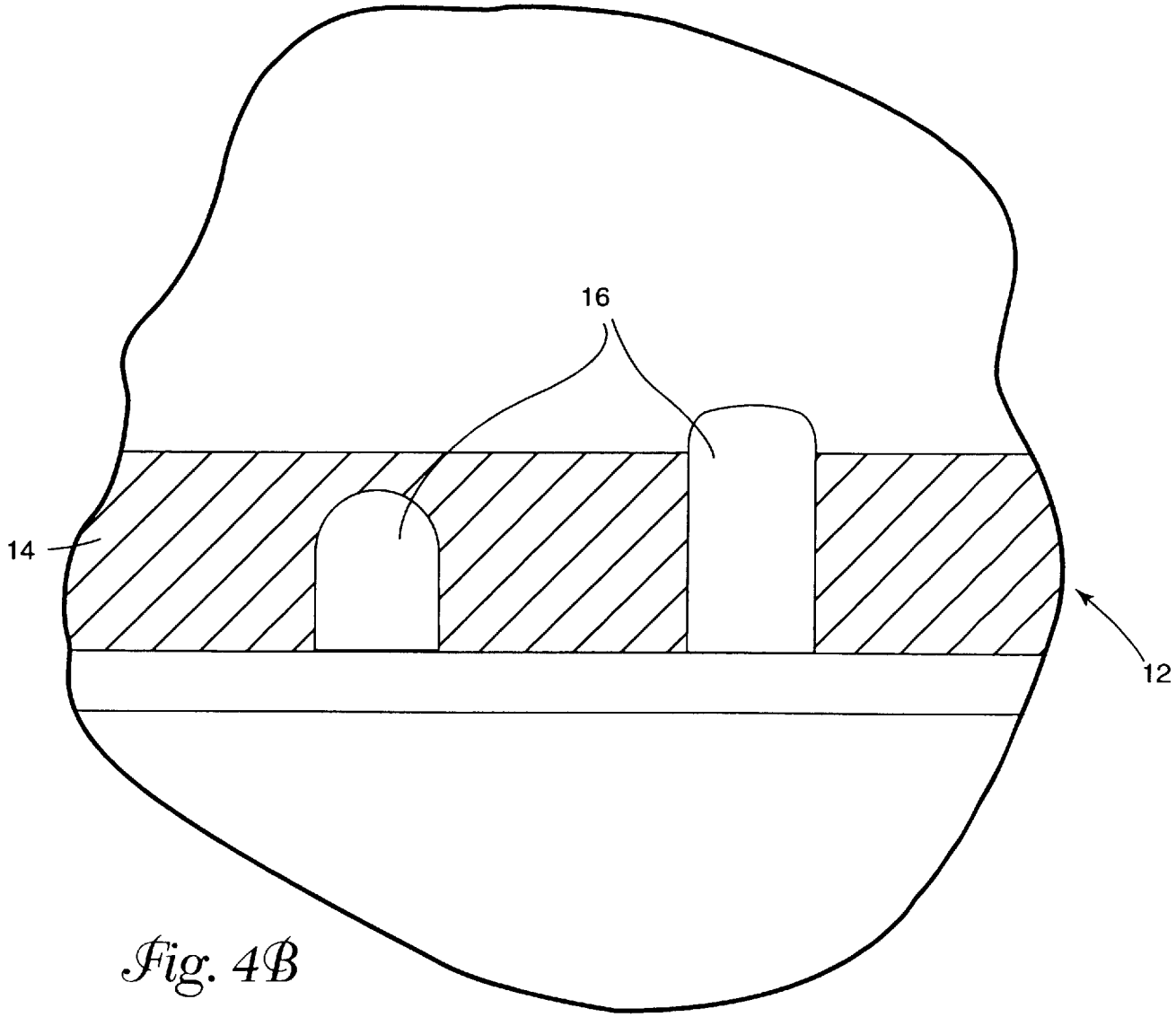
FIG. 4B is a side elevational view of another alternative embodiment of the invention depicting protrusions of varying height.

The relative height of the projection and blade may also be varied depending upon the effect that is to be created in the block split according to the invention. Specifically, as can be seen in FIG. 3 the relative height of the blade 14 may be less than the relative height of the projection 16. Alternatively, as can be seen in FIG. 4A the relative height of the blade may be greater than the height of the projections 26. Generally, we have found with the first splitting blade assembly that X may range from about ⅛ to about ⅜ of an inch beyond the first blade. With regard to the second splitting blade assembly, X' may range from about 1/16 to ⅛ of an inch beyond the height of the plurality of the projections.

Protrusions 16 such as those depicted in FIG. 2A have been found useful having a diameter of about 1 and ¼ inches and, when used with a blade 14, having a height of about ⅛ of an inch above the blade in the first or lower assembly and ⅛ of an inch below the blade in the second or upper assembly. Overall, the height of the protrusions may vary up or down about ⅜ of an inch relative to the height of the blade.

Figure 5:
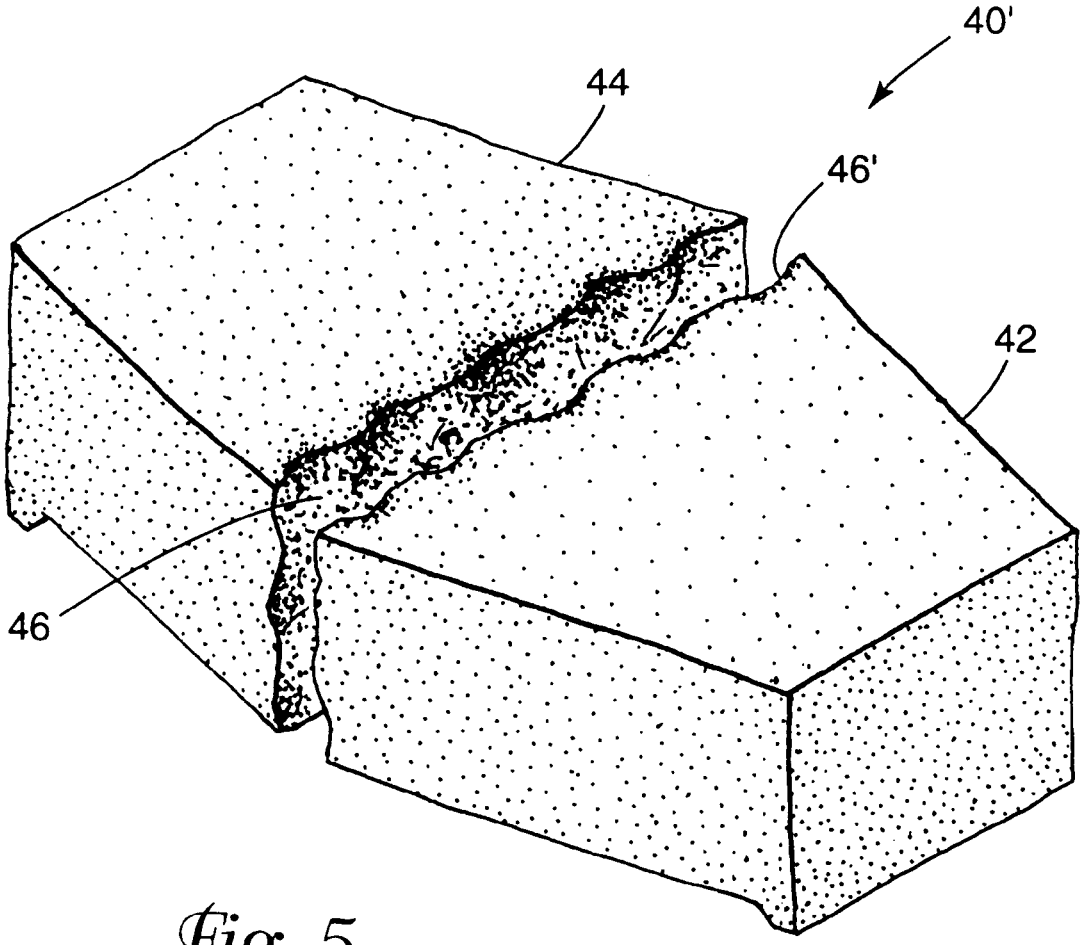
FIG. 5 is a perspective view of a split work piece, (forming two masonry blocks), which was split using the splitter blade assembly of the invention.

In operation, the work piece is generally centered in the block splitter according to known practices as seen in FIGS. 1 and 2. The block splitter is then activated resulting in the first and second opposing splitting blade assemblies converging on, and striking, the work piece 40. In operation, the first and second splitting blade assemblies may travel anywhere from about ¼ to one inch into the top and bottom surfaces of the work piece. The work piece 40 is then split resulting in an uneven patterning on the split edges 46 and 46' of the resulting blocks, 42 and 44, as illustrated in FIG. 5. As depicted, the work piece 40' is split in two. However, it is possible and within the scope of the invention to split the work piece into more than two pieces.

The distance traveled by the protrusions 16 into the work piece may be varied by adjusting the limit switches on the machine and, in turn, varying they hydraulic pressure with which the splitting assembly acts. Generally, the splitting assemblies act on the block with a pressure ranging from about 600 to 1000 psi, and preferably about 750 to 800 psi.

As will be well understood by one of skill in the art, the splitting machine may include opposed hydraulically activated side knife assemblies (not shown) which impinge upon the block with the same timing and in the same manner as the opposed top and bottom assemblies. Projections 16 may also be used to supplement or replace the action of the side knives.

Figure 6:
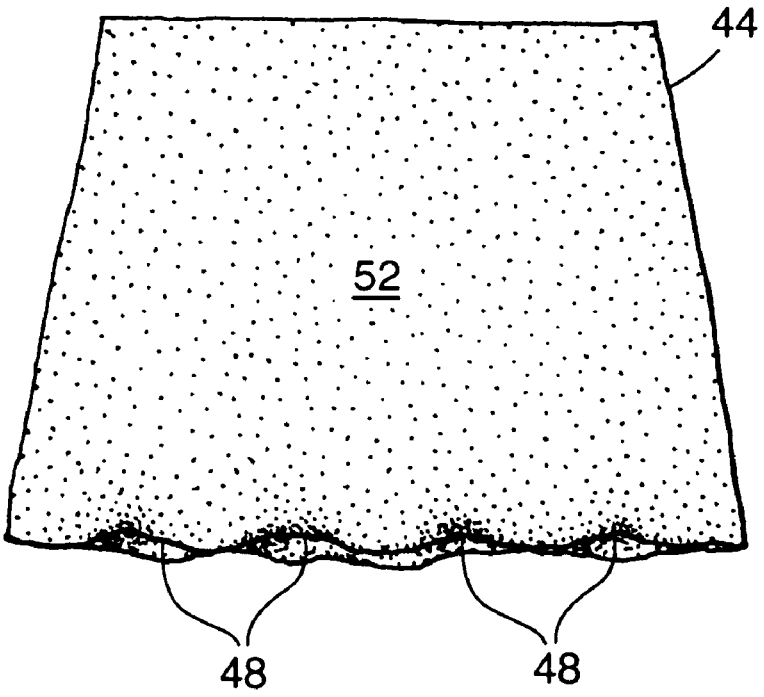
FIG. 6 is a top plan view of a masonry block split using the splitter blade assembly of the invention.
Figure 7:
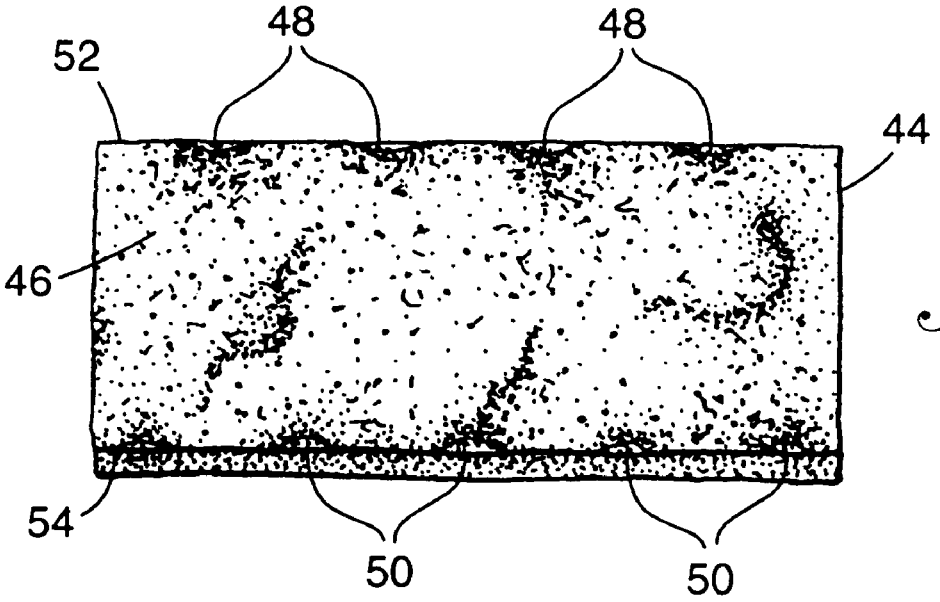
FIG. 7 is a front elevational view of the masonry block depicted in FIG. 6.
Figure 8:
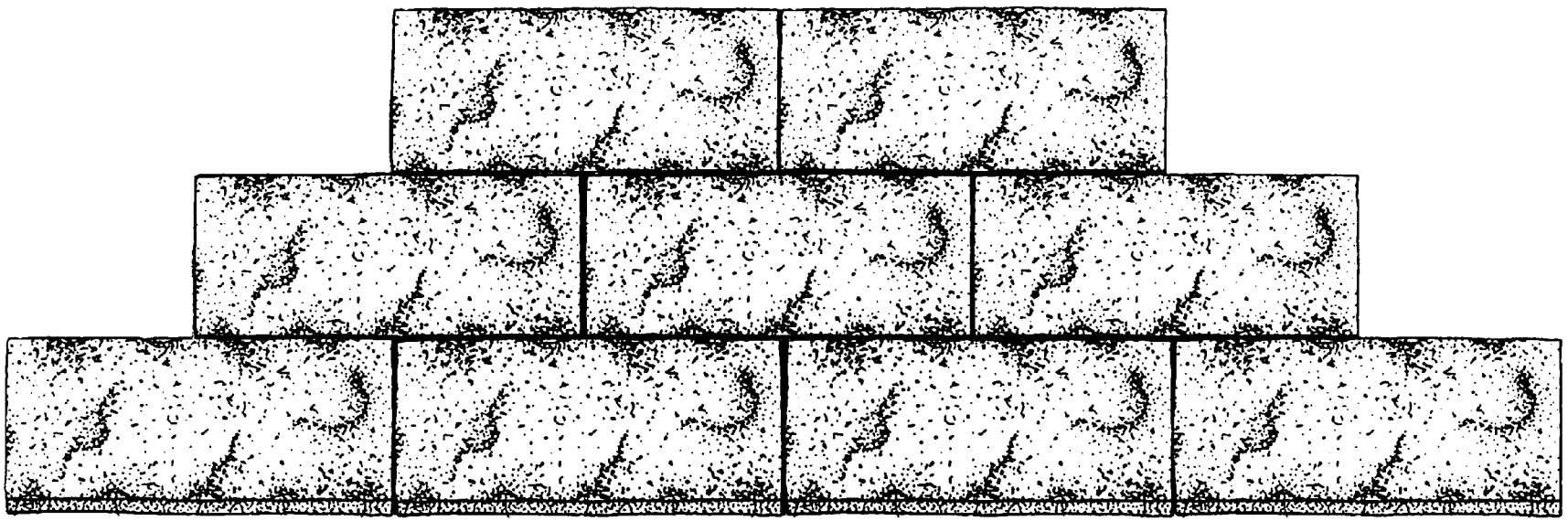
FIG. 8 is a front view of a retaining wall formed from a plurality of the masonry blocks of FIGS. 6 and 7.

Closer examination of block 44 after splitting (see FIGS. 6 and 7) shows the formation of exaggerated points of erosion in the front, split surface 46 of the block 44. With the block 44 depicted, both the first and second blade assemblies 12 and 22 comprised protrusions 16 and 26, respectively. As a result, depressions 48 and 50 were formed in the front, split surface 46 of the block 44, adjacent the upper 52 and lower 54 respective surface of the block 44.

The magnitude of the indentations, 48 and 50, or points of erosion is far greater than that which is caused by conventional splitting blades and may be varied by varying the prominence of the protrusions 16 and 26, (height and size), relative to the height and thickness of the blade. In one embodiment of the invention, masonry block may be split with only a row or rows of protrusions 16 and 26 without a blade 14 and 24.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A block splitter assembly comprising first and second opposed splitting blade assemblies, each of said first and second splitting blade assemblies comprising respective first and second splitting blades and a plurality of projections positioned adjacent to each of said first and second blades, said projections being positioned so that they travel into a work piece as it is split into at least two pieces by the block splitter assembly, whereby said projections contribute to the formation of at least one irregular split edge and surface on at least one of the split pieces.

2. The assembly of claim 1, wherein said projections have a rounded shape.

3. The assembly of claim 1, wherein each of said projections comprises a top surface.

4. The assembly of claim 3, wherein at least one of said projections has a top surface comprising at least one point.

5. The assembly of claim 1, wherein said projections that are adjacent said first splitting blade have a height which extends beyond said first splitting blade.

6. The assembly of claim 5, wherein said projections extend about ⅛ to ⅜ of an inch beyond said first splitting blade.

7. A block splitter assembly comprising first and second opposed splitting blade assemblies, each of said first and second splitting blade assemblies comprising respective first and second splitting blades and a plurality of projections positioned adjacent to each of said first and second blades, said projections having a pyramidal shape and said projections being positioned so that they travel into a work piece as it is split into at least two pieces by the block splitter assembly, whereby said projections contribute to the formation of at least one irregular split edge and surface on at least one of the split pieces.

8. A block splitter assembly comprising first and second opposed splitting blade assemblies, each of said first and second splitting blade assemblies comprising respective first and second splitting blades and a plurality of projections positioned adjacent to each of said first and second blades, said second blade having a height which extends beyond said plurality of projections and said projections being positioned so that they travel into a work piece as it is split into at least two pieces by the block splitter assembly, whereby said projections contribute to the formation of at least one irregular split edge and surface on at least one of the split pieces.

9. The assembly of claim 8, wherein said second blade extends about 1/16 to ⅛ of an inch beyond said projections.

10. A block splitter comprising first and second opposed splitting assemblies, each of said first and second opposed splitting assemblies comprising a plurality of projections, wherein at least one of said splitting assemblies comprises a splitting blade and a plurality of said projections positioned adjacent each side of said splitting blade, said projections being positioned so that they travel into a work piece as it is split into at least two pieces by the block splitter, whereby said projections contribute to the formation of irregular split edges and surfaces on the split pieces.

11. The splitter of claim 10, wherein said projections have a height which extends above said splitting blade.

12. The splitter of claim 11, wherein said projection height extends about ⅛ to ⅜ of an inch beyond said splitting blade.

13. The splitter of claim 10, wherein said splitting blade has a height which extends above said projections.

14. The splitter of claim 13, wherein said splitting blade height extends about 1/16 to ⅛ of an inch beyond said projections.

15. A block splitter comprising first and second opposed splitting assemblies, each of said first and second opposed splitting assemblies comprising a plurality of projections, said projections having a pyramidal shape and being positioned so that they travel into a work piece as it is split into at least two pieces by the block splitter, whereby said projections contribute to the formation of at least one irregular split edge and surface on at least one of the split pieces.

16. A masonry block splitter comprising first and second opposed splitting blade assemblies, said first blade assembly comprising a first splitting blade having first and second sides, said first blade assembly comprising a plurality of projections adjacent said first splitting blade first side and a plurality of projections adjacent said first splitting blade second side, said second blade assembly comprising a second splitting blade having first and second sides, said second blade assembly comprising a plurality of projections adjacent said second splitting blade first side and a plurality of projections adjacent said second splitting blade second side, said projections being positioned so that they travel into a work piece as it is split into at least two pieces by the masonry block splitter, whereby said projections contribute to the formation of irregular split edges and surfaces on the split pieces.

17. The splitter of claim 16, wherein said first blade has a length and the plurality of projections adjacent said first splitting blade first side are aligned with the plurality of projections adjacent said first splitting blade second side along the length of said first blade.

18. The splitter of claim 16, wherein said second blade has a length and the plurality of projections on said second splitting blade first and second sides are aligned along the length of said second blade.

19. The splitter of claim 16, wherein said projections have a rounded shape.

20. The splitter of claim 16, wherein said projections have a pyramidal shape.

21. The splitter of claim 16, wherein each of said projections comprises a top surface.

22. The splitter of claim 21, wherein at least one of said projections has a top surface which is pointed.

23. The splitter of claim 16, wherein said first blade assembly projections have a height which extends above said first splitting blade.

24. The splitter of claim 23, wherein said projection height extends about ⅛ to ⅜ of an inch beyond said first blade.

25. The splitter of claim 16, wherein said second blade has a height which extends beyond said second blade assembly projections.

26. The assembly of claim 25, wherein said second blade height extends about 1/16 to ⅛ of an inch beyond said second blade assembly projections.

27. A method of splitting masonry block using a masonry block splitter, comprising:

providing first and second opposed splitting blade assemblies, said first blade assembly comprising a first splitting blade having first and second sides, said first blade assembly comprising a plurality of projections adjacent said first splitting blade first side and a plurality of projections adjacent said first splitting blade second side, said second blade assembly comprising a second splitting blade having first and second sides, said second blade assembly comprising a plurality of projections adjacent said second splitting blade first side and a plurality of projections adjacent said second splitting blade second side, said projections being positioned so that they travel into the masonry block as it is split by said splitting blade assemblies; and striking the masonry block with said first and second opposed splitting blade assemblies, whereby said projections contribute to the formation of irregular split edges and surfaces on the resulting split pieces of the masonry block.

28. The method of claim 27, wherein said first splitting blade assembly travels about ½ to 1 inch into the block.

29. A block resulting from the method of claim 28.

30. The method of claim 27 wherein said second splitting blade assembly travels about ½ to 1 inch into the block.

31. A block resulting from the method of claim 30.

32. The method of claim 27, wherein said first splitting blade strikes the top of the block.

33. The method of claim 27, wherein said second splitting blade strikes the bottom of the block.

34. A block resulting from the method of claim 27.

35. A retaining wall comprising more than one block from any of claims 34, 29, or 31.

36. A masonry block splitter having a splitting line with which a work piece is aligned for splitting the work piece into at least two pieces, comprising a splitting assembly including a plurality of projections adjacent the splitting line, said projections being positioned so that they travel into the work piece as it is split into the at least two pieces by the block splitter, whereby said projections contribute to the formation of at least one irregular split edge and surface on at least one of the split pieces.

37. The masonry block splitter of claim 36, including a splitting blade aligned with the splitting line.

38. The masonry block splitter of claim 36, wherein said projections are rounded.

39. A masonry block splitter having a splitting line with which a work piece is aligned for splitting the work piece into at least two pieces, comprising first and second opposed splitting assemblies, at least one of said assemblies including a plurality of projections adjacent the splitting line, said projections being positioned so that they travel into the work piece as it is split into the at least two pieces by the block splitter, whereby said projections contribute to the formation of at least one irregular split edge and surface on at least one of the split pieces.

40. The masonry block splitter of claim 39, further including a plurality of said projections on each side of the splitting line.

41. The masonry block splitter of claim 39, wherein at least one of said splitting assemblies includes a splitting blade aligned with the splitting line.

42. The block splitter of claim 41, wherein said projections are positioned adjacent both sides of said splitting blade.

43. The block splitter of claim 39, wherein said projections are rounded.

44. A masonry block splitter having a splitting line with which a work piece is aligned for splitting the work piece into at least two pieces, comprising first and second opposed splitting assemblies, each of said assemblies comprising a plurality of projections adjacent the splitting line, said projections being positioned so that they travel into the work piece as it is split into the at least two pieces by the block splitter, whereby said projections contribute to the formation of at least one irregular split edge and surface on at least one of the split pieces.

45. The masonry block splitter of claim 44, further including a plurality of said projections on each side of the splitting line.

46. The masonry block splitter of claim 44, wherein at least one of said splitting assemblies includes a splitting blade aligned with the splitting line.

47. The masonry block splitter of claim 46, wherein a plurality of said projections are positioned adjacent each side of said splitting blade.

48. The masonry block splitter of claim 44, wherein each of said splitting assemblies includes a splitting blade aligned with the splitting line.

49. The masonry block splitter of claim 48, wherein a plurality of said projections are positioned adjacent each side of at least one of said splitting blades.

50. The masonry block splitter of claim 49, wherein a plurality of said projections are positioned adjacent each side of each said splitting blade.

51. The masonry block splitter according to claims 36, 39 or 44, wherein the work piece is split into at least two blocks.

52. A splitting blade assembly for use in a block splitter, comprising:

a mounting base, said mounting base including a splitting blade; and a plurality of projections disposed on said mounting base adjacent said splitting blade, said projections being constructed so that during splitting they travel into a work piece as it is split into at least two pieces, whereby said projections contribute to the formation of at least one irregular edge and surface on at least one of the split pieces.

53. The splitting blade assembly according to claim 52, wherein said projections are positioned on each side of said splitting blade.

54. The splitting blade assembly according to claim 52, wherein said projections are adjustably mounted on said mounting base.

55. The splitting blade assembly according to claim 52, wherein said mounting base includes two surfaces on opposite sides of said splitting blade, and a plurality of said projections are mounted on each of said surfaces.

* * * * *